US011235899B2

(12) United States Patent
Lucey et al.

(10) Patent No.: US 11,235,899 B2
(45) Date of Patent: Feb. 1, 2022

(54) APPARATUS AND METHOD FOR CONFIGURING AND OPENING PRODUCT PACKAGING

(71) Applicant: ECOLAB USA INC., Saint Paul, MN (US)

(72) Inventors: Ryan David Lucey, Saint Paul, MN (US); Christopher John Opelt, Saint Paul, MN (US); David M. Shoberg, Saint Paul, MN (US); Brian P. Carlson, Saint Paul, MN (US); Paul R. Kraus, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 82 days.

(21) Appl. No.: 16/270,301

(22) Filed: Feb. 7, 2019

(65) Prior Publication Data

US 2019/0241299 A1 Aug. 8, 2019

Related U.S. Application Data

(62) Division of application No. 13/313,173, filed on Dec. 7, 2011, now abandoned.

(51) Int. Cl.

| | |
|---|---|
| ***B65B 61/06*** | (2006.01) |
| ***B65B 61/18*** | (2006.01) |
| ***B65D 75/58*** | (2006.01) |

(52) U.S. Cl.

CPC ..... *B65B 61/184* (2013.01); *B65D 75/5838* (2013.01); *B65B 61/06* (2013.01)

(58) Field of Classification Search

CPC ..... B65B 61/18; B65B 61/184; B65B 53/00; B65B 69/00; A47L 5/02

See application file for complete search history.

(56) References Cited

U.S. PATENT DOCUMENTS

| | | | | |
|---|---|---|---|---|
| 1,657,391 A * | 1/1928 | Haney | C11D 17/00 510/439 |
| 3,273,302 A * | 9/1966 | Walter | B65B 61/02 53/412 |
| 3,834,525 A * | 9/1974 | Morgese | B65D 71/08 206/161 |
| 4,406,364 A | 9/1983 | Bronander, Jr. | |
| 4,420,080 A | 12/1983 | Nakamura | |
| 4,552,269 A | 11/1985 | Chang | |

(Continued)

FOREIGN PATENT DOCUMENTS

| | | |
|---|---|---|
| JP | 2009113819 A | 5/2009 |
| WO | 2010001903 | 1/2010 |

*Primary Examiner* — Chelsea E Stinson

(74) *Attorney, Agent, or Firm* — McKee, Voorhees & Sease, PLC

(57) ABSTRACT

An apparatus and method for configuring product packaging and removal of the packaging from a product is disclosed. The labeled product packaging includes a shrink wrap packaging adapted for sealing around a product. A predefined point of failure is configured in the packaging and includes a failure mode for when pulled in at least one direction. A label is sealed to the packaging and adhered to the predefined point of failure in covering relation over the predefined point of failure. Lifting the label from the packaging tears open the packaging starting at the predefined point of failure so the product can be removed from the packaging.

12 Claims, 7 Drawing Sheets

(56) References Cited

U.S. PATENT DOCUMENTS 4,586,312 A * 5/1986 Limousin ..... B65B 61/02 493/363
4,739,879 A 4/1988 Nakamura
4,840,270 A 6/1989 Caputo et al.
4,848,575 A 7/1989 Nakamura et al.
5,264,265 A 11/1993 Kaufmann
5,310,262 A 5/1994 Robison et al.
5,409,116 A 4/1995 Aronsen
5,539,648 A 7/1996 Baker
5,664,677 A 9/1997 O'Connor
5,908,246 A * 6/1999 Arimura ..... B65D 75/5838 229/123.2
6,006,500 A * 12/1999 Craig ..... B65B 25/026 53/397
6,047,882 A 4/2000 Sin et al.
6,113,271 A 9/2000 Scott et al.
6,126,009 A 10/2000 Shiffler et al.
6,554,134 B1 4/2003 Guibert
6,767,604 B2 7/2004 Muir et al.
6,889,483 B2 5/2005 Compton et al.
7,021,827 B2 4/2006 Compton et al.
7,228,968 B1 6/2007 Burgess
7,302,783 B2 12/2007 Cotert
7,318,941 B2 1/2008 Poupard et al.
7,350,688 B2 4/2008 Sierra-Gomez et al.
7,475,781 B2 1/2009 Kobayashi et al.
8,276,350 B2 10/2012 Bouzas et al.
9,725,198 B2 8/2017 Whang et al.
2004/0245139 A1 12/2004 Mangold et al.
2005/0276525 A1* 12/2005 Hebert ..... B65D 75/5833 383/203
2008/0060751 A1 3/2008 Arrindell
2008/0199109 A1 8/2008 Rutzinger et al.
2010/0111453 A1 5/2010 Dierl
2010/0113241 A1 5/2010 Hebert et al.
2010/0300915 A1* 12/2010 Kakura ..... B65D 75/5838 206/494
2011/0139864 A1 6/2011 Wipf

* cited by examiner

APPARATUS AND METHOD FOR CONFIGURING AND OPENING PRODUCT PACKAGING

CROSS-REFERENCE TO RELATED APPLICATIONS

This application is a Divisional Application of U.S. Ser. No. 13/313,173, filed on Dec. 7, 2011. The contents of the application are hereby incorporated by reference in its entirety and for all purposes.

BACKGROUND OF THE INVENTION

Field of the Invention

This invention relates generally to an apparatus and method for configuring and opening product packaging and more particularly to an apparatus and method for labeled packaging and an easy method for removal of the labeled packaging from the product.

Description of the Prior Art

Product packaging can be difficult to apply and remove depending upon the type of packaging that is preferred for use with the product. Packaging that seals the product can be both onerous and complicated to remove or separate it from the product. Peel wrap, for example, is applied to shrink wrap packaging and functions as an opening feature for the customer or end-user to use to remove the product packaging. This and many other current features used to assist in opening shrink wrapped product are widely viewed as unnecessarily complicated and unreliable.

It is therefore desirable to provide a cost efficient and effective way to configure the packaging and labeling on a product to aid in the removal of packaging from the product.

It is further desirable to provide reliable packaging that is easily removed.

It is further desirable to provide product packaging for pressed solid products that is configured for easy removal and separation from the pressed solid product.

SUMMARY OF THE INVENTION

In one embodiment, the invention is a method for removing packaging from a product. The method includes providing a product in a packaging having a label covering a predefined failure point in the packaging. The steps include lifting the label from the packaging to tear open the packaging starting at the predefined failure point and separating the packaging from the product. In a preferred form, the lifting step includes separating a portion of the label from packaging around a portion of the predefined failure point without tearing open the packaging. For example, lifting in one direction prevents tearing of the predefined failure point in the packaging thereby permitting reapplication of the label and preservation of the packaging while lifting in another direction tears open the packaging.

In another embodiment, the invention is labeled product packaging. The packaging is shrink wrap packaging that is adapted for sealing around a product. A predefined point of failure is configured in the packaging. The predefined point of failure has a failure mode for when pulled in at least one direction away from the packaging. A label is secured to the packaging in covering relation over the predefined point of failure. The label is also sealed to the packaging and adhered to the predefined failure point. In a preferred form of the invention, the product is a block of solid detergent, and the predefined point of failure is a cut through the packaging in the shape of an "X", a crescent or a "V".

DETAILED DESCRIPTION OF THE PREFERRED EMBODIMENTS

Figure 1A:
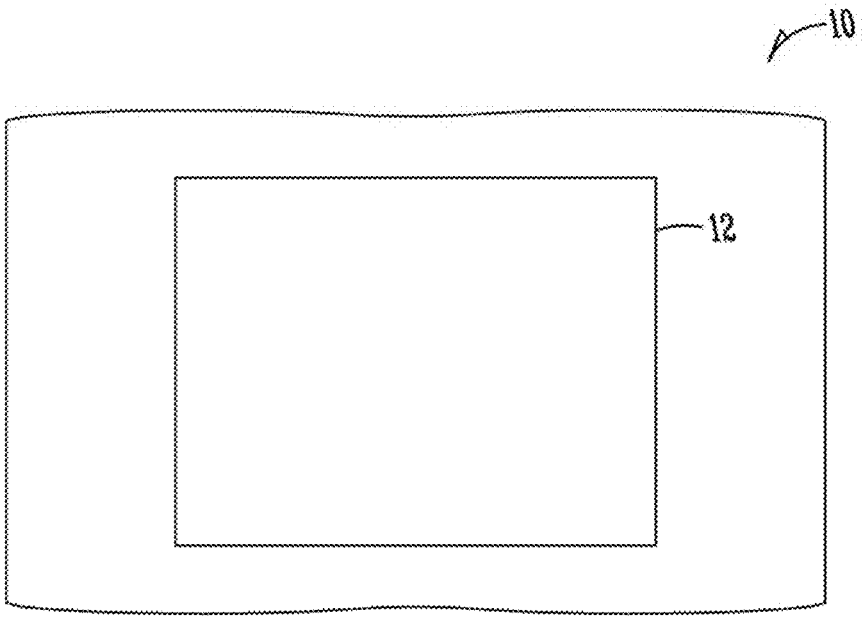
FIG. 1A front elevation view of a product with labeled packaging according to one aspect of the invention.
Figure 1B:
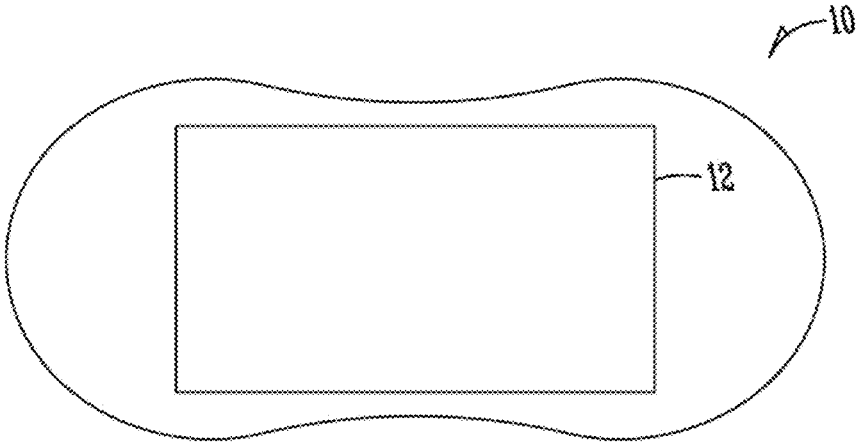
FIG. 1B is a top view of a product with labeled packaging according to another aspect of the invention.

Product packaging can encompass use of numerous types of packaging enclosing various types of product. In one aspect of the present invention, shrink wrap is used as a product packaging 10 as illustrated in FIGS. 1A-B for enclosing a product such as a pressed solid or cast block of detergent. The product packaging 10 can include one or more labels 12 positioned on one or more surfaces of the product packaging 10. For example, label 12 could be positioned on a top or bottom face of the product packaging 10 as illustrated in FIG. 1B or on a front or back face of the product packaging 10 as illustrated in FIG. 1A. Labeling could also be printed directly onto the product packaging 10. The product packaging 10 generally assumes the shape of the enclosed product. For example, as illustrated in FIGS. 1A-B, the product packaging 10 has a peanut shape as a result of the enclosed product being peanut-shaped. Thus, labeling such as label 12 illustrated in FIGS. 1A-B may be positioned on a surface of the product packaging 10 that is generally planar or non-planar. Because the product packaging 10, such as shrink wrap, follows closely the contour or outer surface of the enclosed product, removal of the product packaging 10 can be complicated and difficult. Furthermore, it is important that the product packaging 10 remain sealed until the product is used. What follows is a description of the invention which allows for easy removal of the product packaging 10 and access to the enclosed, sealed product.

In one aspect of the invention, the product packaging 10 includes a label 12 applied to the packaging after it is sealed around an enclosed product. For example, in the case of the product packaging being shrink wrap, the shrink wrap and enclosed product are run through a heat tunnel prior to label application. The label 12 may include various forms of information, artwork, company marks, branding, product ingredients and use suggestions, source or manufacture of the product, and instructions for removing the packaging 10 or reapplying the label 12. The label 12 is adhered to the surface of the underlying product packaging 10 using a light or medium grade adhesive as is further defined below.

Figure 2A:
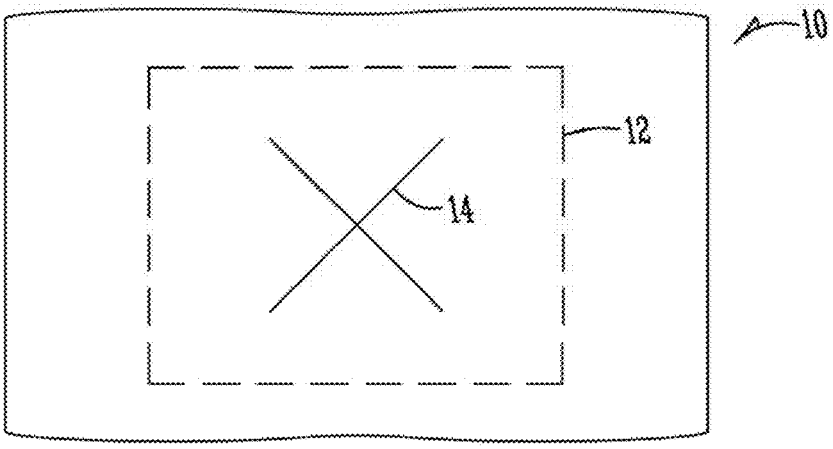
FIG. 2A is a front elevation view of a design for a predefined point of failure in the packaging according to one embodiment of the invention.
Figure 2B:
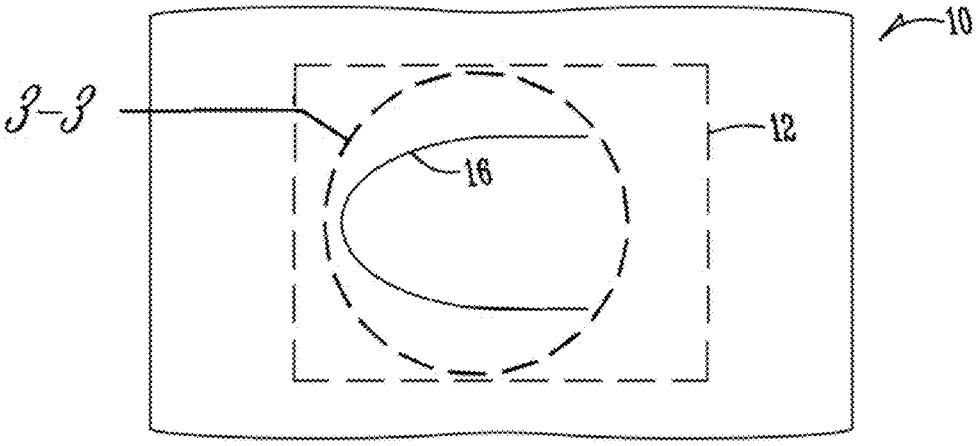
FIG. 2B is a front elevation view of another design for a predefined point of failure in the packaging.
Figure 2C:
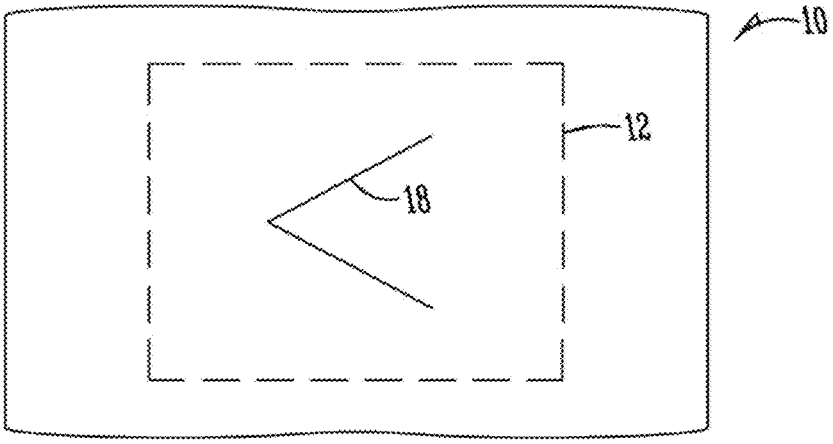
FIG. 2C is a front elevation view of another design for a predefined point of failure in the packaging.

In one aspect of the present invention, after the product packaging is applied so as to enclose the product and before the label 12 is adhered to the product packaging 10, a predefined point of failure 14, 16 or 18 as illustrated in FIGS. 2A-C is configured in the product packaging 10. For example, in the case where the product packaging 10 is shrink wrap, the shrink wrap and the enclosed product are run through a heat tunnel before the predefined point of failure is formed in the product packaging 10. Making the predefined point of failure after heat tunneling minimizes label 12 alignment and cutting issues relating to formation of the predefined point of failure.

FIGS. 2A-C illustrate exemplary embodiments of a predefined point of failure 14, 16 and 18 of the present invention. For example, as illustrated in FIG. 2A, the predefined point of failure 14 is generally an "X" shape. The predefined point of failure 14 may be formed by cutting the product packaging 10 in the desired shape, perforating the product packaging 10 in the desired shape or generally weakening the material of the product packaging 10 in a desired shape. In FIG. 2B, the predefined point of failure 16 is formed in a crescent shape and in FIG. 2C the predefined point of failure 18 is formed in a horizontal "V" shape. In each instance, the predefined point of failure may be formed by a cut passing through the entirety of the product packaging 10, a perforation of the product packaging 10 or a weakening of the product packaging 10. FIGS. 2A-C illustrate some exemplary shapes and geometries of a predefined point of failure. The present invention contemplates that other shapes and/or geometries may be used to form a predefined point of failure in the product packaging 10. For example, the predefined point of failure could be an oval, "U", or rectangular shape. Depending upon the desired functionality, certain shapes may achieve the objections of the present invention better than others as described below.

As shown in FIGS. 2A-C, label 12 is positioned and adhered to the product packaging in covering relation over the predefined point of failure 14, 16 and 18. By encompassing the entire predefined point of failure, the label 12 acts as a protective mechanism that prevents dirt, moisture, or other contaminates from contacting the enclosed product through the predefined point of failure. Thus, the label 12 adheres to the product packaging 10 and the predefined point of failure to seal the packaging to protect and preserve the enclosed product.

Figure 3:
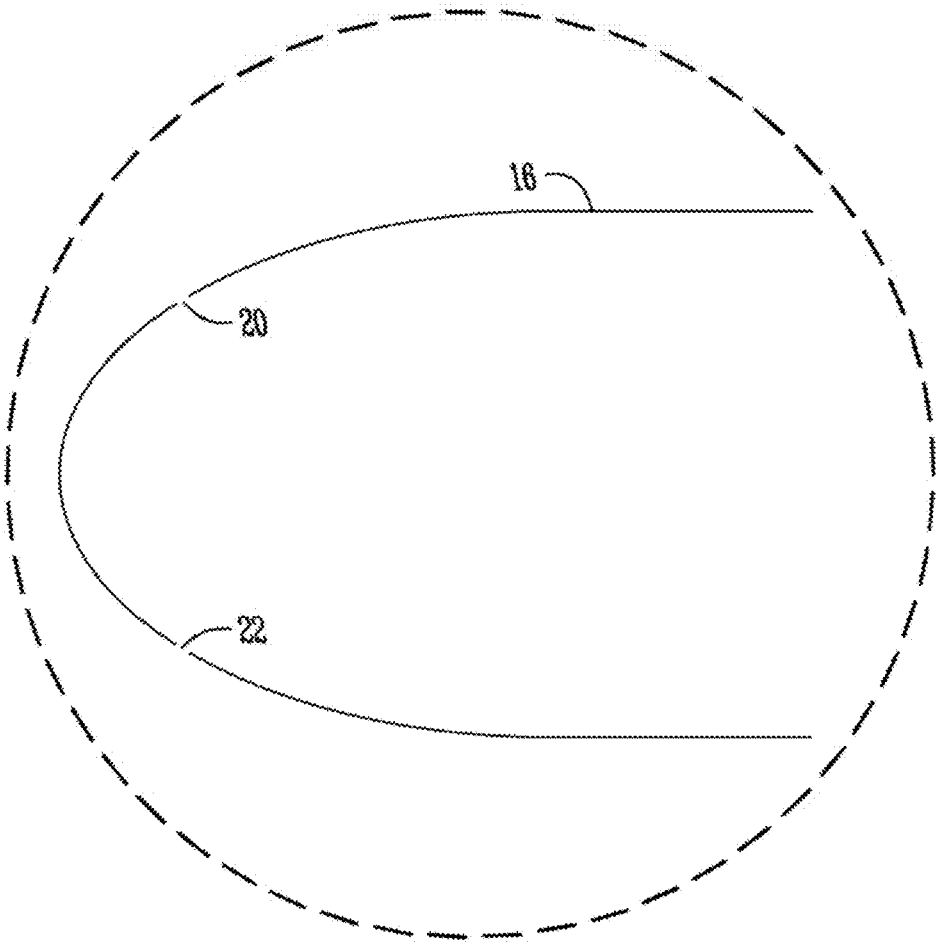
FIG. 3 is an enlarged view taken along line 3-3 in FIG. 2B of one embodiment of a predefined point of failure.
Figure 4A:
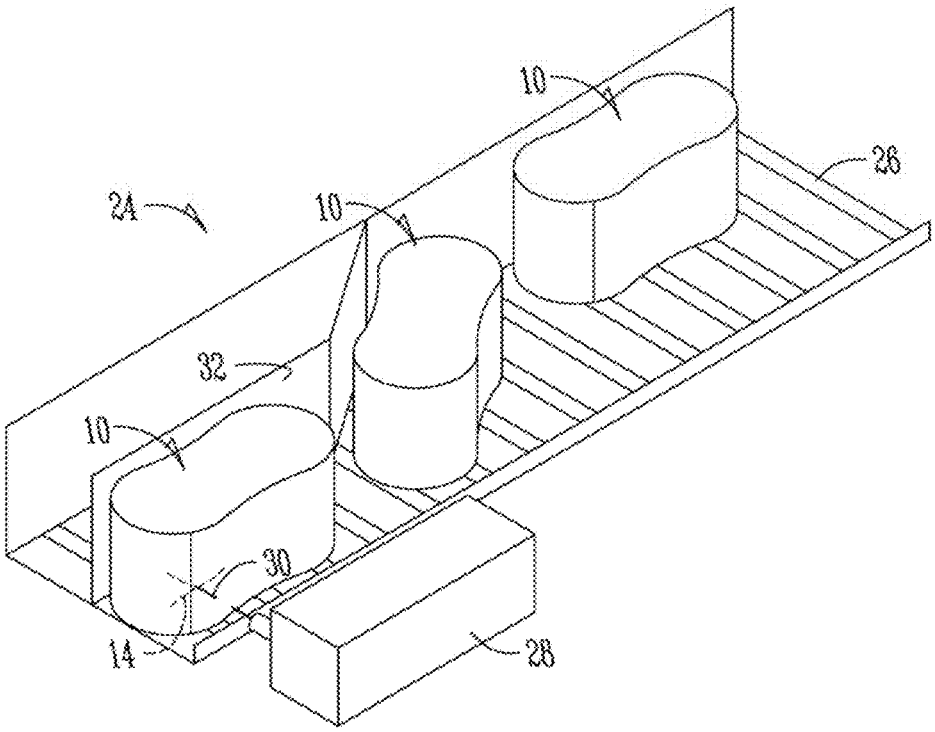
FIG. 4A is a perspective view of a process for cutting the predefined point of failure in the product packaging according to one embodiment of the present invention.
Figure 4B:
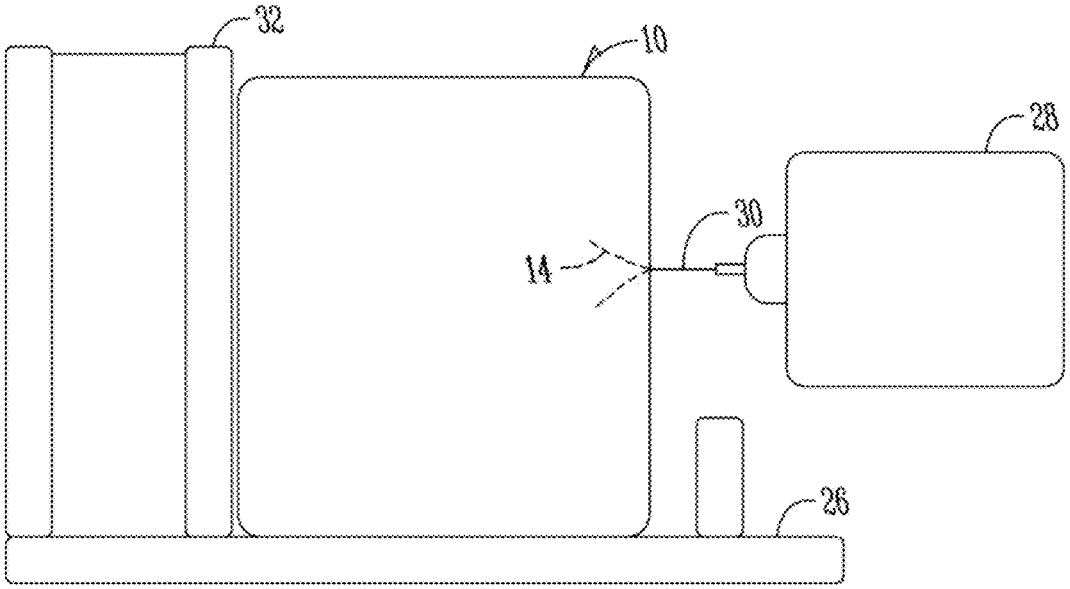
FIG. 4B is an end view of the process shown in FIG. 4A.
Figure 4C:
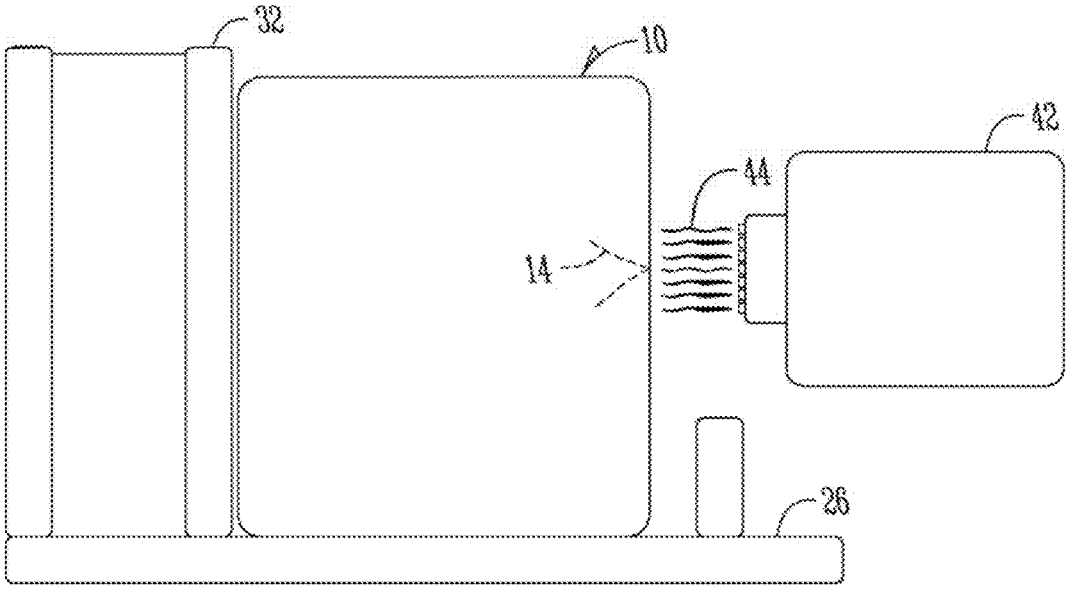
FIG. 4C is an end view of a process for cutting the predefined point of failure in the product packaging according to another embodiment of the present invention.
Figure 4D:
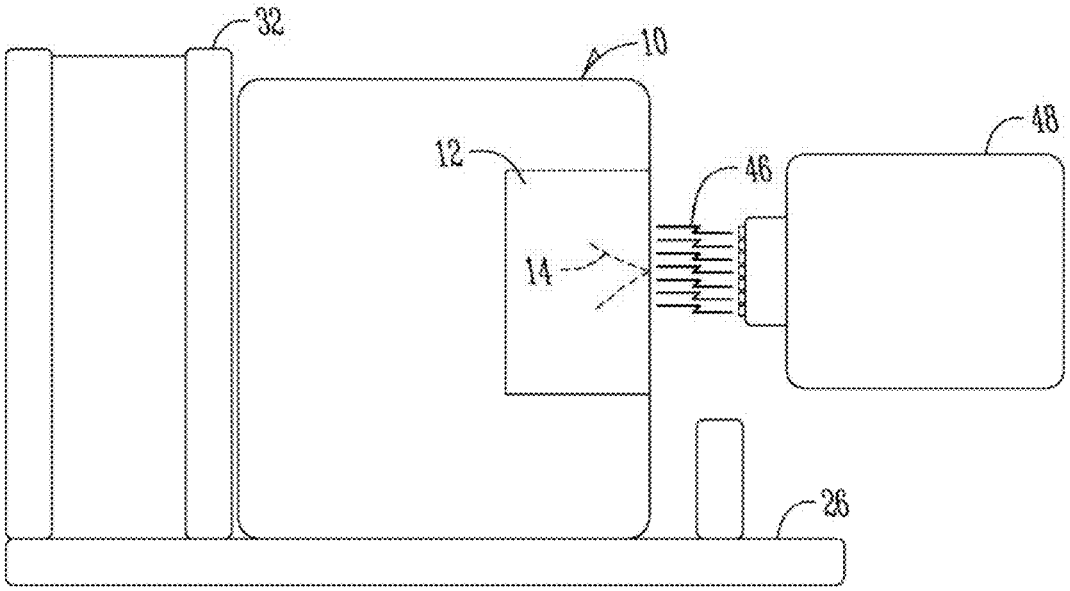
FIG. 4D is an end view of a process for cutting the predefined point of failure in the product packaging according to another embodiment of the present invention.

As indicated, the predefined point of failure may be formed in the product packaging 10 by a cut passing through the entirety of the product packaging 10, a perforation in the product packaging 10 or intermittent cuts in the product packaging 10 formed in the shape of the predefined point of failure. The predefined point of failure may also include a weakening of the product packaging 10 in the shape of the predefined point of failure. FIG. 3 illustrates one example taken from the predefined point of failure 16 illustrated in FIG. 2B. In FIG. 3, the predefined point of failure 16 is cut into the product packaging 10 and forms a crescent shape. The crescent shape is used here as an example since the following configuration could be applied to the other shapes discussed and considered above. The cut extends through the product packaging 10 to form the shape of the predefined point of failure 16 with the exception of a portion of the product packaging that forms tabs 20 and 22. Here, the product packaging 10 within the crescent shape remains attached to the product packaging 10 without outside the crescent shape via tabs 20 and 22. The tabs 20 and 22 keep the product packaging 10 within the predefined point of failure 16 generally on the same plane as the product packaging 10 outside of the predefined point of failure 16. The tabs 20 and 22 also allow the material within the predefined point of failure 16 to remain taut without creating an unattended separation or gap between the product packaging 10 within the predefined point of failure 16 and the product packaging 10 outside of the predefined point of failure 16. This is particularly useful in the instance where the enclosed product has one or more non-planar surfaces such as illustrated in FIGS. 1B and 4A. The tabs 20 and 22 help prevent the predefined point of failure 16 from adhering to a surface of the enclosed product, such as by static electricity, thereby residing in a plane or position than the product packaging 10 around the predefined point of failure 16. Keeping the product packaging 10 around the predefined point of failure 16 generally in the same plane allows the label 12 to adhere to the surface of the product packaging 10 and the predefined point of failure thereby ensuring that when the label 12 is applied to the product packaging 10, the label 12 adheres to the entire of the product packaging 10 beneath the label 12 and not just the surface of the packaging around the predefined point of failure.

FIGS. 4A-D illustrate several aspects of the invention for forming a predefined point of failure in product packaging 10. For example, a laser cutting system 24 may be used to configure a predefined point of failure in product packaging 10. In this manner, the product is enclosed within shrink wrap packaging as previously discussed and moved along a conveyor 26. A positioner 32 moves and holds the product packaging 10 in a fixed distance away from the laser 28. The laser beam 30 emitted from the laser 28 is then used to create a predefined point of failure 14 in the product packaging 10. The predefined point of failure, as previously described, may include a continuous cut, a partial cut, a perforated cut, or a weakening of the product packaging 10. Positioning the product packaging 10 a fixed distance from the laser 28 permits a fixed power setting to be used for the laser 28 so as to not affect the enclosed product, particularly when cutting a predefined point of failure on a non-planar surface of the product packaging 10 as illustrated in FIG. 4A. In one aspect of the invention, a laser from a laser manufacturer/provider such as Preco, Inc. or LasX may be used to form a predefined point of failure in the product packaging 10. In another aspect of the invention, a heating element 42 shaped in the form of a predefined point of failure may be used to cut or form a predefined point of failure 14 in the product packaging 10. This could include a heating element 42 having a "X", crescent or horizontal "V" shape. The temperature 44 of the heating element could be controlled so as to control the cut or weakening of the product packaging 10 in order to form a desired predefined point of failure 14. With each of these methods, the predefined point of failure is created in the product packaging 10 before the label 12 is applied or adhered to the product packaging 10 in covering relation over the predefined point of failure. In another aspect of the present invention, a foil may be included or incorporated into a label 12 and formed in the shape of a predefined point of failure such as an "X" shape, crescent shape or generally horizontal "V" shape. The label 12 having the foil is then adhered to product packaging 10 onto a desired surface of the product packaging 10.

Here, the product packaging 10 does not include a predefined point of failure before application of the label 12. To form the predefined point of failure in the shape of foil, the label 12 is exposed 46 to magnetic energy 48 which thereby heats the foil creating a predefined point of failure in the product packaging 10 beneath the label 12 and in the shape of the foil. Thus, the predefined point of failure is created in the product packaging 10 while the label 12 is adhered to the product packaging 10. In this manner, the product packaging 10 remains sealed at all times even while the predefined point of failure is being formed in the product packaging 10.

Figure 5A:
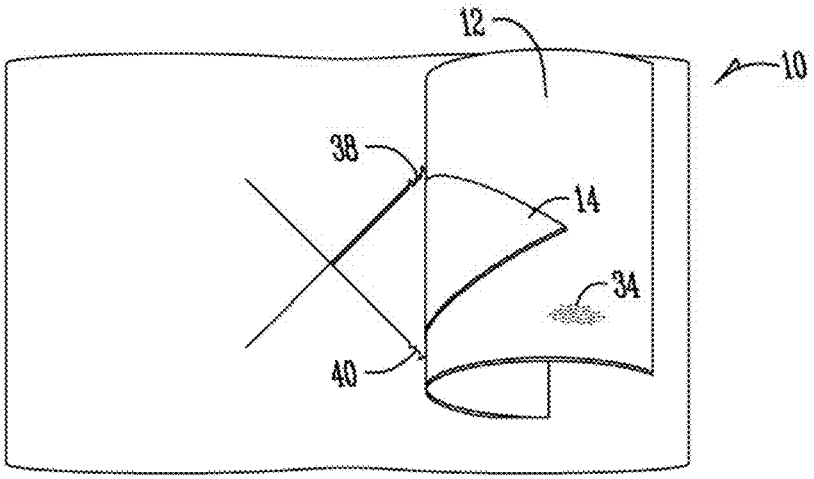
FIG. 5A is a front elevation view illustrating opening of the product packaging for the predefined point of failure shown in FIG. 2A.
Figure 5B:
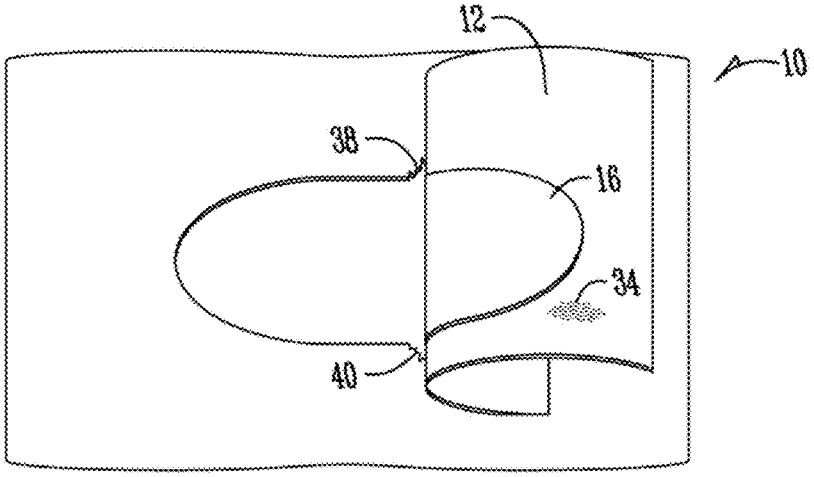
FIG. 5B is a front elevation view illustrating opening of the product packaging for the predefined point of failure shown in FIG. 2B.
Figure 5C:
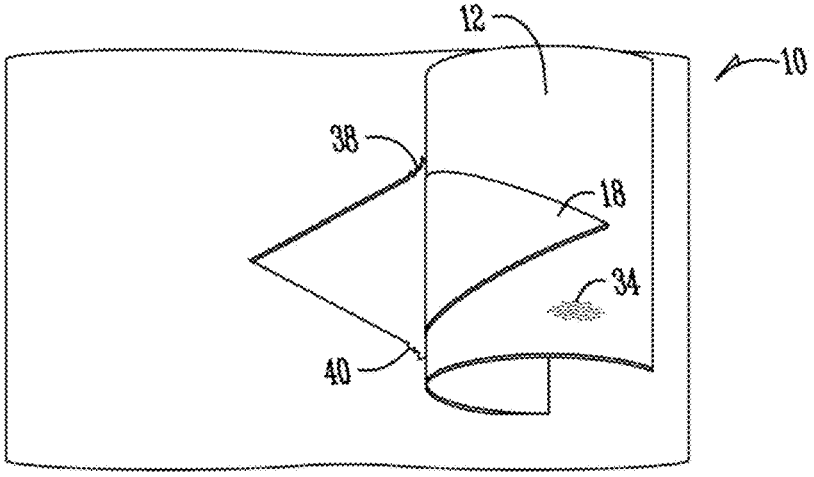
FIG. 5C is a front elevation view illustrating opening of the product packaging for the predefined point of failure shown in FIG. 2C.
Figure 6A:
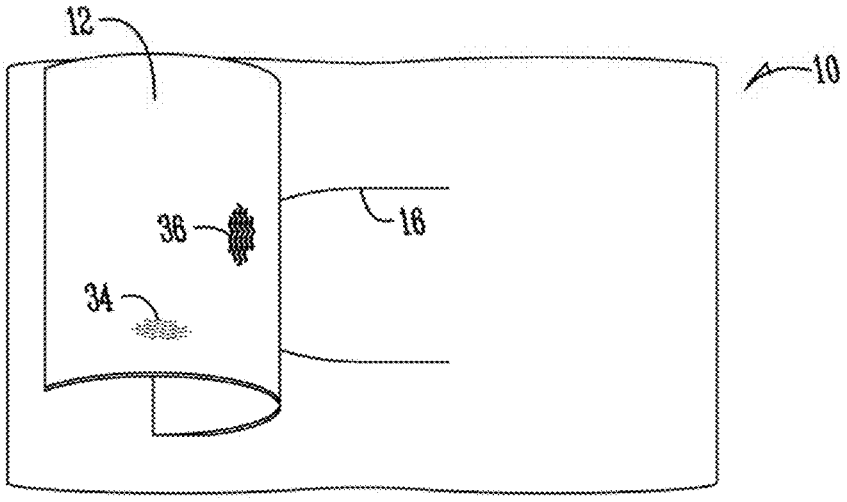
FIG. 6A is a front elevation view illustrating removal of a label from the predefined point of failure shown in FIG. 2B without removing the packaging.
Figure 6B:
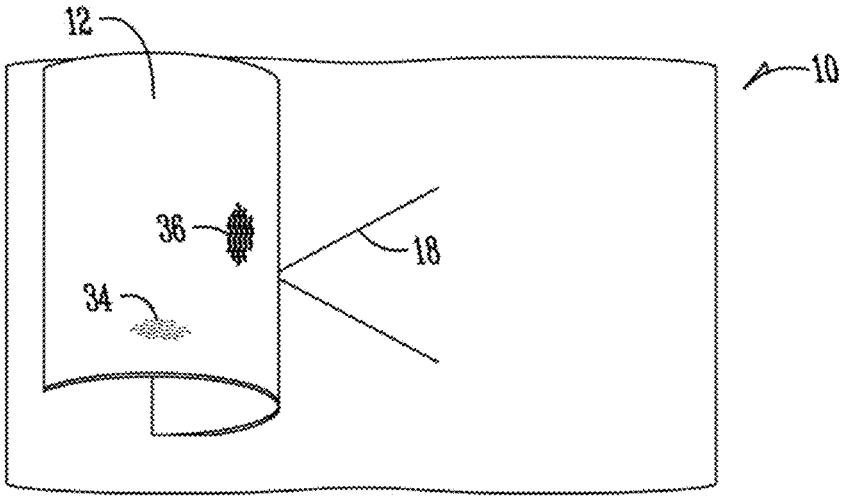
FIG. 6B is a front elevation view illustrating removal of a label from the predefined point of failure shown in FIG. 2C without removing the packaging.

FIGS. 5A-C illustrate exemplary aspects of the invention for removing product packaging 10 from product enclosed in the packaging. As previously indicated, the label 12 is adhered to the product packaging 10. In one aspect of the invention, a light or medium grade adhesive 34 is applied to the backside of a label 12. A stronger adhesive 36 such as illustrated in FIGS. 6A-6B may be applied to the portion of label 12 in contact with the predefined point of failure to permit separation between the label 12 and the product packaging 10 while maintaining adherence of the label 12 to the predefined point of failure. In FIG. 5A, the predefined point of failure 14 is formed in the shape of an "X". A corner or edge of the label 12 is lifted and separated from the product packaging 10. As the label 12 is torn from the product packaging 10, the label 12 remains adhered to the predefined point of failure 14 thereby forming tears 38 and 40 in the product packaging 10 which continue to propagate through the product packaging 10 while the label 12 is further lifted and torn from the product packaging 10. Continuing to pull the label 12 from product packaging 10 tears the product packaging 10 to allow the product enclosed in the product packaging 10 to be separated from the product packaging 10 with ease. FIGS. 5B-C illustrate how the product packaging 10 is opened using the crescent shape predefined point of failure 16 and the horizontal "V" shape predefined point of failure 18. Like FIG. 5A, the label 12 is lifted from the product packaging 10. The predefined point of failure 16 and 18 remain adhered to the label 12 thereby forming tears 38 and 40 in the product packaging 10 which propagate through the product packaging 10 as the label 12 is further torn from the product packaging 10. As previously indicated, the label 12 may include various types of indicia such as instructions on how to remove the label 12 and thereby tear open the product packaging 10.

FIGS. 6A-B illustrate the dual functionality of certain shapes of predefined points of failure of the present invention. In certain instances, depending upon the shape of the predefined point of failure, the label 12 may be removed and reapplied without opening the product packaging 10. Also, the label may be replaced with another label without opening the product packaging 10. For example, in instances where the label 12 needs reapplied, replaced or adjusted because it was applied incorrectly, is the wrong label or is misaligned, the label 12 may be removed from the product packaging 10 without tearing the product packaging 10. In FIG. 6A, the predefined point of failure 16 is in the shape of a crescent as illustrated in FIGS. 2B and 5B. Lifting the label 12 in one direction as illustrated in FIG. 5B tears open the product packaging 10; however, lifting the label 12 in the opposite direction permits the label 12 to be separated from the product packaging 10 without tearing the product packaging 10 as illustrated in FIG. 6A. Thus, in the case where the predefined point of failure is formed in the direction in which the label 12 is peeled, the label 12 is permitted to separate from the product packaging 10 without tearing the product packaging 10. The label 12 then may be reapplied and used to subsequently tear open the product packaging 10 as illustrated in FIG. 5B. Similarly, in FIG. 6B, to remove label 12 without tearing product packaging 10, the label 12 is peeled off in the direction of the predefined point of failure 18. One or more tabs, such as tabs 20 and 22 illustrated in FIG. 3 may be included in the predefined point of failure 16 and 18 in FIGS. 6A-B to further prevent unintentional tearing of the product packaging 10 when the label 12 is peeled in the direction of the predefined point of failure. As previously indicated, the label 12 may include one or more types of adhesive. For example, a light adhesive 34 may be used for generally adhering to the surface of the product packaging 10 around the predefined point of failure whereas a stronger adhesive 36 may be used to adhere the label 12 to the predefined point of failure itself. The bonding strength of the adhesive 36 is sufficient to maintain adherence to the predefined point of failure when the label 12 is lifted from the product packaging 10 as illustrated in FIGS. 5A-C, but still permits the label 12 to be removed and reapplied as shown in FIGS. 6A-B.

In another aspect of the present invention, the product packaging may be without a label. In this manner the predefined point of failure configured in the product packaging is left uncovered. As discussed above, the predefined point of failure may include tabs to keep it from unintentionally opening thereby keeping the product packaging generally sealed until opened. The predefined point of failure could be also be configured as a perforation or by intermittent cuts passing through the packaging. The packaging remains generally sealed until the user grips the predefined point of failure and begins to separate it from the packaging. The packaging separates along the predefined point of failure first and then forms one or more tears that propagate into the packaging to open it. Indicia may be printed directly on the packaging indicating to the user how to open it.

The above Specification, examples, and data provide a complete description of the manufacturing and use of the composition of the invention. Since many embodiments of the invention can be made without departing from the spirit and scope of the invention, the invention resides in the claims hereinafter appended.

What is claimed is:

1. An industrial combination for producing a packaged, solid product, said combination comprising:

a solid product;

a packaging enclosing the solid product, the packaging comprising:

shrink wrap packaging sealed around the solid product; and a predefined point of failure in the shrink wrap packaging having a first end, a second end, tabs configured to interrupt the predefined point of failure between the first end and the second end such that there is at least one gap in the predefined point of failure in which at least part of the packaging within the predefined point of failure remains attached to at least part of the packaging outside the predefined point of failure, and a failure mode for when pulled in at least one direction away from the packaging;

a manufacturing assembly comprising:

a conveyer;

a laser, a heating element, or a magnetic energy source for cutting the predefined point of failure into the shrink wrap packaging; and a positioner for moving and holding the packaging at a fixed distance from the laser, the heating element, or the magnetic energy source; and a label in covering relation over at least a portion of the predefined point of failure, the label being sealed to the packaging and adhered to the predefined failure point.

2. The combination of claim 1, wherein the predefined failure point comprises a cut.

3. The combination of claim 2, wherein the cut is in the shape of:

a. a cross;

b. a crescent; or c. an acute angle.

4. The combination of claim 1, wherein the label includes an embedded foil for creating the predefined point of failure after the label is applied to the packaging by exposing the embedded foil to magnetic energy.

5. The combination of claim 1, wherein the label includes a first adhesive on a portion of the label in contact with the packaging, and a second adhesive on a portion of the label in contact with the predefined failure point.

6. The combination of claim 5, wherein the second adhesive has a greater bonding characteristic than the first adhesive.

7. The combination of claim 1, wherein said predefined failure point comprises a curve.

8. The combination of claim 1, wherein the solid product comprises a pressed solid or a cast solid.

9. An industrial combination for producing a solid, packaged product, said combination comprising:

a solid product comprising a pressed solid product or a cast solid product; and a packaging enclosing said solid product and including a predefined point of failure having a first end, a second end, tabs configured to interrupt the predefined point of failure between the first end and the second end such that there is at least one gap in the predefined point of failure in which at least part of the packaging within the predefined point of failure remains attached to at least part of the packaging outside the predefined point of failure; and a manufacturing assembly comprising:

a conveyer;

a laser, a heating element, or a magnetic energy source for cutting the predefined point of failure into the packaging; and a positioner for moving and holding the packaging at a fixed distance from the laser, the heating element, or the magnetic energy source.

10. The combination of claim 9, further comprising a label in covering relation over at least a portion of the predefined point of failure, the label being sealed to the packaging and adhered to the predefined failure point.

11. The combination of claim 10, wherein the predefined point of failure comprises:

a. a cut in the packaging; or b. intermittent cuts in the packaging.

12. The combination of claim 11, wherein the label is positioned relative to the predefined point of failure such that the label overlaps the predefined point of failure.

* * * * *